United States Patent [19]

Barlow

[11] 4,051,450

[45] Sept. 27, 1977

[54] WAVEGUIDES

[75] Inventor: Harold Everard Monteagle Barlow, Epsom, England

[73] Assignee: National Research Development Corporation, London, England

[21] Appl. No.: 672,600

[22] Filed: Apr. 1, 1976

[30] Foreign Application Priority Data

Apr. 3, 1975 United Kingdom ..... 13691/75

[51] Int. Cl.[2] ..... H01P 1/16; H01P 3/12; H01P 3/20

[52] U.S. Cl. ..... 333/95 R; 333/95 S; 333/97 R; 333/98 M

[58] Field of Search ..... 333/95 R, 95 S, 98 R, 333/21 R, 97 R, 84 R, 96; 350/96 WG

[56] References Cited

U.S. PATENT DOCUMENTS

| | | | |
|---|---|---|---|
| 3,668,574 | 6/1972 | Barlow | 333/95 S |
| 3,772,619 | 11/1973 | Clarricoats | 333/95 R |

OTHER PUBLICATIONS

Klopfenstein, "Nonuniform, Inhomogeneous, and Anisotropic Waveguides" in IRE Trans. on Microwave Theory and Techniques, vol. MTT-4, No. 4, pp. 193-196.

*Primary Examiner*—Alfred E. Smith
*Assistant Examiner*—Marvin Nussbaum
*Attorney, Agent, or Firm*—Cushman, Darby & Cushman

[57] ABSTRACT

Waveguides for the dipole mode are described which are of rectangular cross-section with conductive walls and contain one or more longitudinal conductors, or groups of conductors. Where a plurality of conductors are employed they are usually arranged in planes parallel to one wall and are positioned nearer to this wall than the opposite wall. With one conductor or a group of conductors near one wall the dipole mode propagates principally between the conductor or conductors and the nearer wall while the evanescent part of the transverse field is allowed to decay substantially without interference before reaching the far wall.

26 Claims, 8 Drawing Figures

Figure 1A:
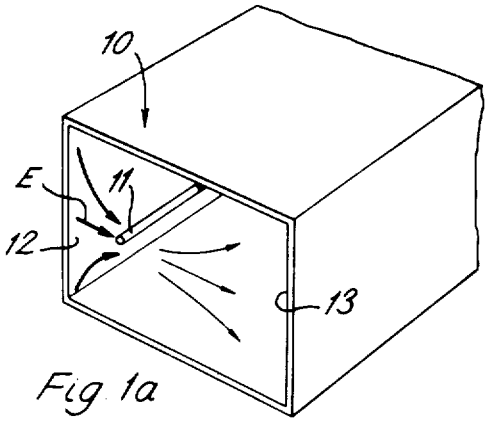

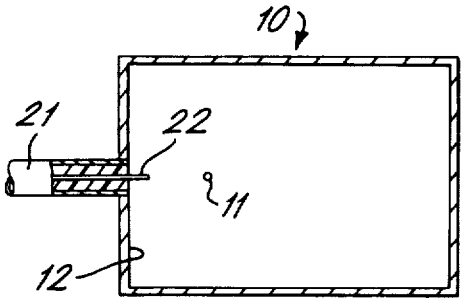
Fig. 3
Fig. 4
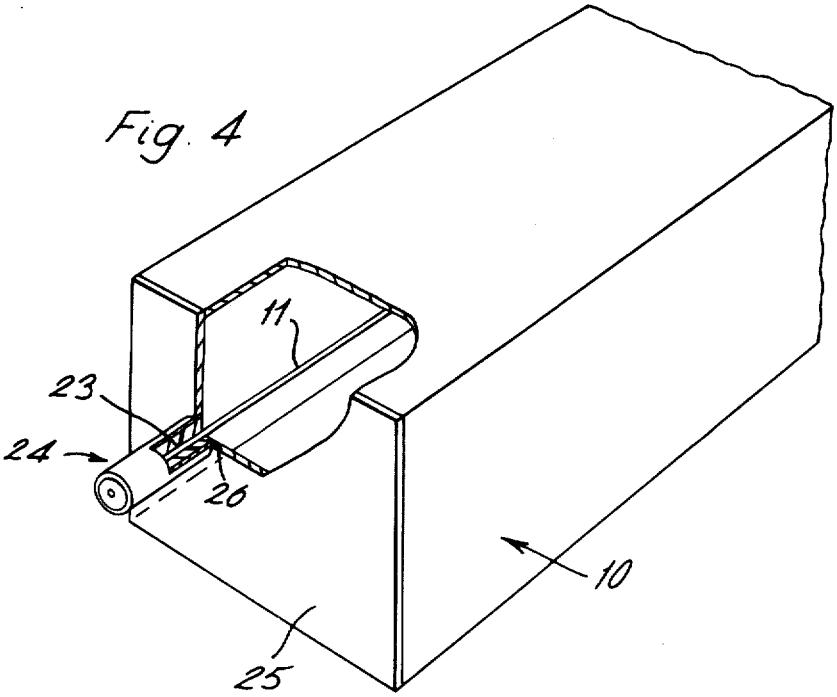

WAVEGUIDES

The present invention relates to waveguides for the transmission of electromagnetic waves in the dipole mode.

An explanation of this mode and a description of various waveguides for supporting the dipole mode are given by the present inventor in (1) British Specification 1,392,452 its corresponding U.S. Pat. No. 3,854,426 and (2) British Patent Applications 38474/73 filed Oct. 17, 1973 and 28836/74 filed June 28, 1974 and corresponding U.S. Pat. No. 3,990,026. The present invention is an improvement in or modification of the invention described in the above mentioned specification and applications.

According to a first aspect of the present invention there is provided apparatus for supporting electromagnetic waves, including a hollow dielectric-filled elongated member with an inner conducting surface, and at least one elongated conductor positioned along the inside of the elongated member, spaced from the said surface, but nearer to the surface on one side of the conductor than on the opposite side, the apparatus being such that electromagnetic waves in the dipole mode are able to propagate in the elongated member, mainly on the said one side of the conductor, between the conductor and the said surface.

According to a second aspect of the present invention there is provided apparatus for supporting electromagnetic waves, including a hollow dielectric-filled elongated member, having a generally planar first wall, two walls adjacent to the first wall and a further wall or walls, generally opposite the first wall, between the said two walls, the walls having inner conductive surfaces, and at least one elongated conductor positioned along the inside of the hollow member and spaced from the walls, the apparatus being such that electromagnetic waves in the dipole mode are able to propagate principally in the space bounded by the first wall, parts of the said two walls and the conductor.

The further wall or walls must be distant enough from the conductor or conductors not to cause substantial interference with the evanescent field which appears between the conductor or conductors and the further wall or walls.

Preferably the conductor is nearer to the first wall than the other walls and its longitudinal axis is parallel to the first wall.

In preferred apparatus according to the invention the hollow member is rectangular in cross-section, with the said two walls parallel and a single further wall opposite and parallel to the first wall. The distance from the further wall to the conductor should advantageously be at least twice the distance from the first wall to the conductor.

An important advantage of the invention is that since the dipole mode is a non-resonant mode, relatively high frequency waveguide (say X band) with at least one internal longitudinal conductor is able to support relatively low frequency signals (say S-band or below) with a comparable loss per unit length to that occurring in resonant waveguide for such low frequencies. Such low frequency signals would be below the cut-off frequency of the waveguide operated in the normal dominant mode and could not propagate therein in the absence of the conductor.

When more than one elongated conductor of circular cross-section is used, the surfaces of the conductors should, for strong transmission, be well spaced from one another at least by a distance equal to the diameter of a conductor. With rectangular cross-section conductors the spacing between adjacent sides may be less than the width of a conductor measured parallel to the said first wall.

Where two or more elongated conductors are positioned in the hollow member they may be positioned in a plane parallel to a wall of the member, and where several groups of such conductors are employed each group is usually positioned in a plane parallel to the plane or planes containing the other group or groups and parallel to a wall of the member. Instead a group of conductors may for instance be positioned in the surface of a hypothetical cylinder with axis parallel to the first wall and equidistant from the said two walls, or groups of conductors may be positioned in the surfaces of similar coaxial cylinders.

It at least two conductors, or two groups of conductors, sufficiently spaced apart in the hollow member, are employed, a first signal may propagate in the dipole mode between one wall and a first conductor or group of conductors adjacent to that wall, and a second signal may propagate in the dipole mode between the opposite wall and a second conductor or group of conductors, adjacent to that opposite wall. A further signal may propagate, preferably in the absence of the other two, in the region between the two conductors or groups of conductors and while the said two signals propagate in the half dipole mode, the further signal propagates in the full dipole mode.

Apparatus according to the invention may include means for launching or sensing waves in the dipole mode. For example a first coupling conductor may extend generally at right angles through an aperture in the said inner surface towards the or one of the longitudinal conductors and a second coupling conductor may be connected to the said surface, the signal to be launched or sensed existing, in operation, between the first and second coupling conductors. Instead, the apparatus may include a conducting end wall at one end of the hollow member generally transverse to the longitudinal direction thereof, the end wall having an aperature through which the, or one of the, longitudinal conductors passes, and the signal to be launched or sensed existing, in operation, between the end wall and that conductor which passes through the end wall.

In this specification the term "dipole mode" means any of the hybrid type $EH_{n-}$ or $HE_{n-}$ waves where the letters E and H signify that there are electric and magnetic field components in the longitudinal direction, the subscript n to one of these letters signifies the number of periods of variation of the transverse field associated with that letter, either in the circumferential direction, for generally circular cross-section waveguides, or, for waveguides having generally parallel conducting surfaces, in the transverse direction normal to the surfaces, and where the subscript '—' signifies that in the radial direction, or in the transverse direction parallel to the said surfaces, the said transverse field is evanescent. Where the waveguide employs a conducting surface acting as an image line, the axis of propagation, in this specification, is in the conducting surface, imaginary fields on that side of the surface remote from the real fields completing a symmetrical field. Thus the half dipole mode which occurs when an image line is used, is considered, for the purposes of this specification, as a form of the dipole mode.

In this specification also the term "dielectric" includes a gas or gaseous mixture such as air, and a vacuum. Preferably the dielectric material is homogeneous.

The invention in its various aspects is expected to be useful in the propagation of electromagnetic waves in "optical waveguides," the wavelengths of waves propagated then being those of light rather than microwaves or lower frequency electromagnetic waves.

Figure 1B:
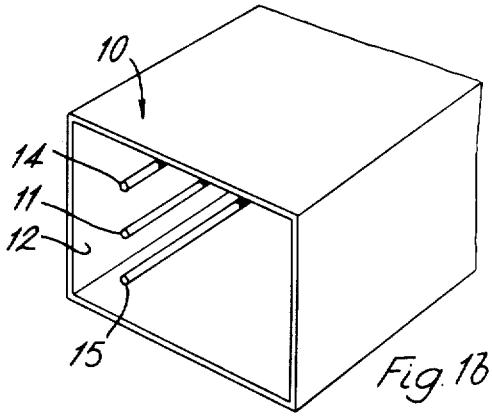
Figure 2A:
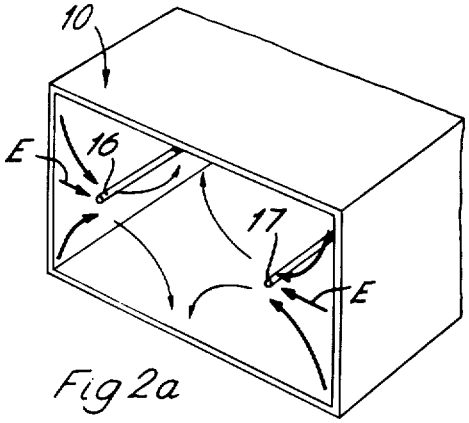
Figure 5:
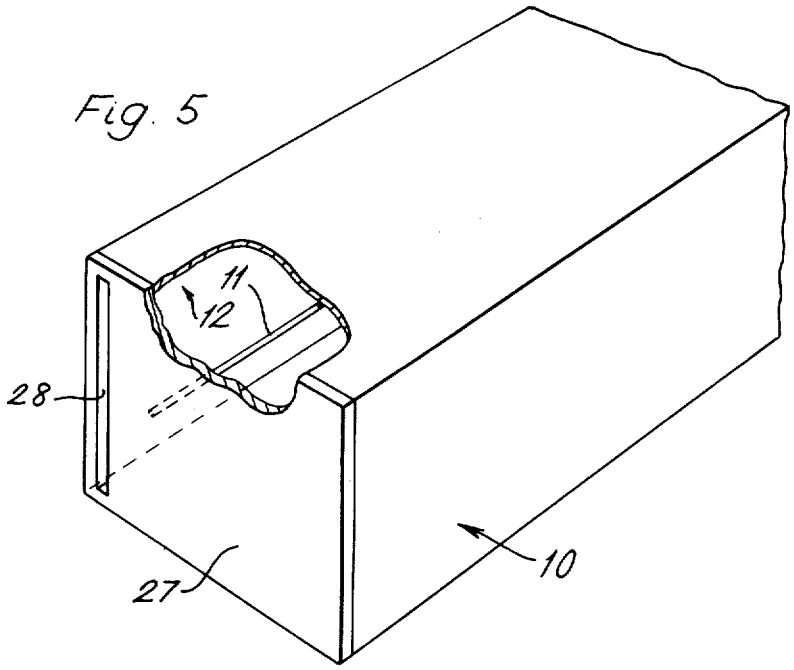
Figure 6:
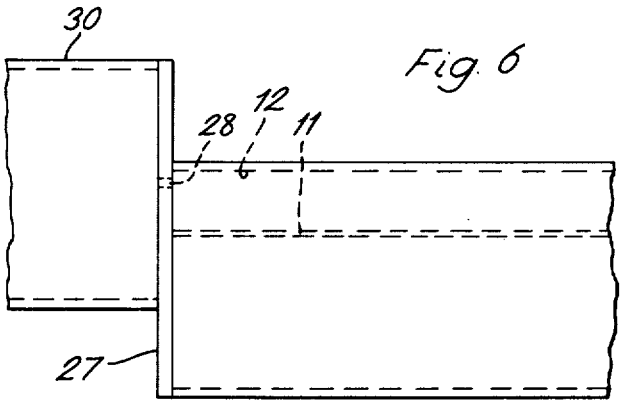

Certain embodiments of the invention will now be described, by way of example, with reference to the accompanying drawings, in which:

FIGS. 1(*a*) and 1(*b*) show cross-sections of waveguide according to the invention for propagating a single signal, FIGS. 2(*a*) and 2(*b*) show cross-sections of waveguide according to the invention for propagating two signals, FIGS. 3 and 4 show arrangements for launching the dipole mode in the waveguide of FIG. 1, FIG. 5 shows part of a further arrangement for launching the dipole mode in the waveguide of FIG. 1, and FIG. 6 shows a plan view of the arrangement of FIG. 5.

In FIG. 1(*a*) an elongated hollow copper member 10 shown in cross-section may be for example X band waveguide measuring approximately 1 cm by 2 cms (inside dimensions). A single elongated conductor 11 supported on polystyrene or other dielectric material spacers (not shown) runs parallel to a wall 12 of the member 10 and at a distance of 0.6 cms. In FIG. 1 and other later Figures, the distance between the conductor or conductors and the nearest wall is exaggerated for clarity.

The U.S. Pat. No. 3,990,026 describes how an open sides waveguide similar to that shown in FIG. 1(*a*) but without a wall 13 is derived from a circular dipole mode waveguide having walls formed by spaced elongated conductors parallel to the direction of propagation. Briefly the circular waveguide is considered as flattened to a point where it has upper and lower parallel conducting surfaces and opposite side walls of parallel conductors. The upper and lower surfaces are then extended to reduce the evanescent field outside the guide, one half of the waveguide is replaced by a conducting surface forming an image line and the conductors are reduced in number to one. The half dipole mode then propagates.

In FIG. 1(*a*) the propagation in the half dipole mode may be regarded as being mainly to the left of the conductor 11 as shown by the arrows E representing the electric field; while only an evanescent field exists to the right of the conductor 11.

The inventor has now discovered that the field to the right of the conductor 11 decays rapidly enough to allow the rectangular cross-section to be completed by the insertion of the conducting wall 13.

While there is substantially no interference with the propagation in the dipole mode to the left of the conductor 11 advantages are gained in that conventional waveguide can be used with the addition of the conductor 11 and the guide is now entirely closed to external fields. Losses of the order of $12 \times 10^{-3}$ Nepers/meter at 3 GHz have been recorded. For the dimensions given in relation to FIG. 1, the amplitude of the electric field just above the wall 13 is approximately one hundredth of the value at the conductor 11, a very small value allowing satisfactory operation. Probably a reduction to one twenty-fifth would give reasonable operation, both incident and reflected fields being evanescent.

The distance between the conductor 11 and the wall 12 is governed by considerations of power carrying capacity. If the distance is too small electric breakdown will occur at high power levels. In air a gradient of about 30,000 volts/cm must not be exceeded.

Instead of a single conductor a number of spaced elongated conductors may be used such as the conductor 11 and conductors 14 and 15 as shown in FIG. 1(*b*). All the conductors are in a plane parallel to the wall 12 and a further row or rows of conductors (not shown) in parallel planes may be used. Instead the conductors could be on the surface of an arc or parallel arcs.

Two dipole mode signals may be transmitted in the same or different directions at the same or different frequencies along the waveguide of FIG. 2(*a*). One signal propagates in the space to the left of a conductor 16 and the other in the space to the right of a conductor 17. Between the conductors 16 and 17 the evanescent fields decay to an extent which prevents substantial mutual interference between the two signals. As before the hollow elongated member 10 is of copper and may be a conventional waveguide. As shown in FIG. 2(*a*) the fields are for signals in phase opposition to allow the field between the conductors 16 and 17 to be accommodated. If, say, the field to the right of the conductor 17 were reversed then the dipole mode could propagate between the conductors 16 and 17, this being a useful mode in some circumstances. Where two signals are transmitted and the fields between the conductors 16 and 17 are not accommodated one with another the distance between the conductors must allow sufficient decay of the evanescent fields to prevent substantial mutual interference.

FIG. 2(*b*) shows an arrangement in which groups 18 and 19 of five conductors each replace the conductors 16 and 17. As in FIGS. 1(*a*) and (*b*) further groups (not shown) of conductors in parallel planes or arcs may be employed.

A signal in the full dipole mode may propagate, in the absence of the other two signals, in the space between the groups of conductors 18 and 19, but preferably further groups of parallel conductors in planes adjacent to the planes of the groups 18 and 19 are provided to reduce the magnitude of the evanescent fields between each of the groups 18 and 19 and the nearer wall to that group.

In order to avoid parasitic modes it is preferable to transmit along the waveguide at frequencies below the cut-off frequency for conventional waveguide transmission. In effect this means the distance between the walls 12 and 13 and therefore the distance between the upper and lower walls of the waveguide 10 must be less than half the free space wavelength at the highest frequency it is required to transmit. A number of standard sizes of rectangular waveguides are made for conventional use (that is in a resonant mode) in the X band, and with the addition of one or more longitudinal conductors such waveguides are suitable for use in the dipole mode at S band or below. Four of these standard sizes have cross-sectional dimensions as follows:

a. One inch by 2 inches outside diameter, with a wall thickness of 0.06 inches, b. ½ inch by 1½ inch outside diameter, with a wall thickness of 0.06 inches, c. ⅜ inch by 1¼ inch outside diameter, with a wall thickness of 0.06 inches, d. ½ inch by 1 inch outside diameter, with a wall thickness of 0.05 inches.

Launching the dipole mode can be achieved as shown in FIG. 3 for the waveguide of FIG. 1 but similar arrangements may be used for the other illustrated waveguides. The signal to be launched is applied to a coaxial line 21 to emerge on a probe formed by the centre conductor 22 of the line positioned in the centre of the wall 12. The outer conductor of the line 21 is electrically connected to the wall 12.

Another way of launching the dipole mode is shown in FIG. 4 where the conductor 11 is joined to, or is integral with, the centre conductor 23 of a coaxial line 24. A conducting transverse wall 25 across one end of the guide 10 has an aperture 26 through which the centre conductor 23 passes and the outer of the coaxial line is electrically connected to the wall 25. The signal to be launched is applied to the line 24.

The dipole mode can also be launched using the arrangement of FIG. 5 where a conducting transverse wall 27 across one end of the guide 10 has a narrow elongated slot 28 between the termination of the conductor 11 and the wall 12. A rectangular waveguide 30 (see FIG. 6) is used to apply an electric field to the slot 28.

The waveguide 30 is too small to support the resonant waveguide mode at the frequency used for transmission so the evanescent $H_{01}$ (that is $TE_{01}$) mode is excited in the waveguide 30 by conventional means. However to avoid excessive attenuation the waveguide 30 may be filled with a solid dielectric. The evanescent mode applies an electric field across the slot 28 which is normal to the long edges of the slot. The field applied in this way has a sine distribution along the slot and is similar to the electric field in the half dipole mode in the vicinity of the slot. Hence the dipole mode is launched; and equally can be sensed in the waveguide 30. The waveguides 10 and 30 are offset from one another as shown in FIG. 6 since the field at the centre of the waveguide 30 approximates to that of the half dipole mode adjacent to the ground plane formed by the wall 12.

Figure 2B:
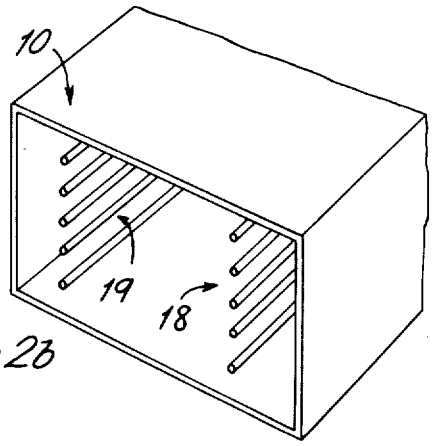

The three types of apparatus for launching may also be used to retrieve signals from the waveguide, and appropriately modified for lauching the full dipole mode between the groups of wires of FIG. 2*b*. If a slot is used in an analogous arrangement to that of FIGS. 5 and 6, the slot would be half way between the two groups of wires.

While several specific embodiments have been described it will be clear that the invention may be put into practice in many other ways. For example the conductors need not be circular in cross-section as shown but may have other cross-sections. Each conductor may be a strip of metal foil mounted on a sheet of dielectric material extending across the waveguide normal to the long sides thereof.

We claim:

1. Apparatus for supporting electromagnetic waves including a hollow dielectric filled member having generally planar inner conducting walls defining an elongated space of substantially constant cross-section, and at least one elongated conductor passing along the length of the space between and parallel to first and second facing walls, the conductor being positioned relatively near the first wall and relatively far from the second wall, and the apparatus being such that electromagnetic waves are able to propagate principally in the region between the conductor and the first wall.

2. Apparatus according to claim 1 wherein the minimum distance between the conductor and the second wall is such that in operation the amplitude of the electric field strength just outside the second wall is less than one twenty-fifth of the amplitude of the electric field strength at the said conductor.

3. Apparatus according to claim 2 wherein the hollow member has third and fourth facing inner walls and the said cross-section is rectangular, the conductor being equidistant from the said third and fourth walls.

4. Apparatus according to claim 3 wherein the distance from the second wall to the conductor is at least twice the distance from the first wall to the conductor.

5. Apparatus according to claim 2 wherein the hollow member has third and fourth facing inner walls, the said cross-section is rectangular, and wherein the said one conductor is one of a plurality of parallel conductors.

6. Apparatus according to claim 5 wherein the conductors are circular in cross-section and their surfaces are spaced from one another at least by a distance equal to the diameter of one of the conductors.

7. Apparatus according to claim 5 wherein the conductors are positioned in a first plane parallel to the first wall.

8. Apparatus according to claim 7 including at least one group of further conductors positioned adjacent to the first plane in a further plane parallel to the first.

9. Apparatus according to claim 5 wherein the conductors are positioned in the surface of a first imaginary cylinder with axis parallel to the first wall and equidistant from the third and fourth walls.

10. Apparatus according to claim 9 including at least one group of further conductors positioned in the surface of a further imaginary cylinder adjacent to the first cylinder and concentric therewith.

11. Apparatus according to claim 3 including a further conductor so positioned parallel to the second wall and equidistant from the third and fourth walls that electromagnetic waves in the dipole mode are able to propagate principally in the region between the conductor and the second wall.

12. Apparatus according to claim 5 including a group of further conductors so positioned with each conductor parallel to the second wall and the third and fourth walls that electromagnetic waves in the dipole mode are able to propagate principally in the region between the second wall and the group of further conductors.

13. Apparatus according to claim 2 including means for launching or sensing waves in the dipole mode within the hollow member.

14. Apparatus according to claim 13 including a first coupling conductor extending generally at right angles through an aperture in the first wall towards the elongated conductor and a second coupling conductor connected to the first wall, the signal to be launched or sensed existing, in operation, between the first and second coupling conductors.

15. Apparatus according to claim 13 including a conducting end wall at one end of the hollow member generally transverse to the conductor, the end wall having an aperture through which the conductor passes, and the signal to be launched or sensed existing, in operation between the end wall and that conductor which passes through the end wall.

16. Apparatus according to claim 13 including a conducting end wall at one end of the hollow member, generally transverse to the conductor, the end wall having a narrow slot extending parallel to the first wall between the first wall and the elongated conductor, and means for exciting the slot to provide an electric field between the longitudinal edges thereof which is approximately the same sine distribution over the length of the slot as the dipole mode electric field is in the vicinity of the slot when propagation in the dipole mode occurs in the direction of the elongated conductor.

17. Apparatus according to claim 3 wherein the cross-sectional dimensions of the hollow member are outside dimensions substantially one inch by two inches, with a wall thickness of 0.064 inches.

18. Apparatus according to claim 3 for dipole mode propagation below a predetermined frequency wherein the distance between the first and second walls and the distance between the third and fourth walls is less than half the free space wavelength at the predetermined frequency.

19. A method of propagating electromagnetic waves, including propagating waves in the dipole mode in apparatus according to claim 3.

20. A method propagating electromagnetic waves, including launching or sensing, and propagating waves in the dipole mode using apparatus according to claim 13.

21. Apparatus according to claim 3, wherein the cross-sectional dimensions of the hollow member are:

outside dimensions substantially ¾ inch by 1½ inches, with a wall thickness of 0.064 inches.

22. Apparatus according to claim 3 wherein the cross-sectional dimensions of the hollow member are:

outside dimensions substantially ⅝ inch by 1¼ inches, with a wall thickness of 0.064 inches.

23. Apparatus according to claim 3 wherein the cross-sectional dimensions of the hollow member are:

outside dimensions substantially ½ inch by 1 inch with a wall thickness of 0.05 inches.

24. Apparatus for supporting electromagnetic waves, including a hollow dielectric filled-member having two pairs of opposite conductive walls defining an elongate space which is rectangular in cross-section, first and second groups of spaced apart conductors in which the conductors of the groups are parallel to one pair of opposite walls, and define a sub-region of the space bounded by the conductors of the first group, the conductors of the second group and the two other opposite walls, the apparatus being such that electromagnetic waves in the dipole mode are able to propagate principally in the sub-region.

25. Apparatus according to clam 24 wherein the first and second groups of conductors are positioned in planes parallel to the said one pair of opposite walls, and each wall of said one pair is positioned far enough from the nearer said parallel plane not to cause substantial interference with the evanescent field which appears between that wall and the said nearer parallel plane.

26. Apparatus for supporting electromagnetic waves, including a hollow dielectric filled member with an inner conducting surface defining an elongated space of substantially constant cross-section, and at least one elongated conductor passing along the length of the space parallel to the conducting surface between first and second facing portions of the surface, the conductor being positioned relatively near the first portion and relatively far from the second portion, and the apparatus being such that electromagnetic waves are able to propagate along the space, mainly in the region between the conductor and first portion.

* * * * *